US007997940B2

(12) United States Patent
Regnier

(10) Patent No.: US 7,997,940 B2
(45) Date of Patent: Aug. 16, 2011

(54) ELECTRICAL CONNECTOR ASSEMBLY FOR AN AIRBAG IGNITOR

(75) Inventor: Vincent Regnier, Nuremberg (DE)

(73) Assignee: FCI, Versailles (FR)

( * ) Notice: Subject to any disclaimer, the term of this patent is extended or adjusted under 35 U.S.C. 154(b) by 257 days.

(21) Appl. No.: 11/921,592

(22) PCT Filed: Jun. 8, 2005

(86) PCT No.: PCT/EP2005/006695

§ 371 (c)(1),
(2), (4) Date: Jan. 27, 2009

(87) PCT Pub. No.: WO2006/131140

PCT Pub. Date: Dec. 14, 2006

(65) Prior Publication Data

US 2009/0209138 A1 Aug. 20, 2009

(51) Int. Cl.
*H01R 24/00* (2011.01)

(52) U.S. Cl. ..... 439/676; 439/272

(58) Field of Classification Search ..... 439/676, 439/587, 271, 272, 281, 732
See application file for complete search history.

(56) References Cited

U.S. PATENT DOCUMENTS

| | | | | |
|---|---|---|---|---|
| 5,145,356 | A | 9/1992 | Minnis | 439/352 |
| 5,842,892 | A | 12/1998 | Heimueller et al. | 439/752 |
| 5,857,864 | A * | 1/1999 | Fukuda | 439/275 |
| 5,876,231 | A * | 3/1999 | Pacher | 439/354 |
| 6,443,764 | B2 * | 9/2002 | Makita | 439/587 |
| 6,669,509 | B2 * | 12/2003 | Ichida et al. | 439/595 |
| 2001/0024908 | A1 | 9/2001 | Nakamura et al. | 439/676 |

FOREIGN PATENT DOCUMENTS

| | | |
|---|---|---|
| EP | 0 867 975 A2 | 9/1998 |
| JP | 03-130471 | 12/1991 |
| JP | 04-81477 | 7/1992 |
| JP | 05-17959 | 3/1993 |
| JP | 2001-319725 | 11/2001 |
| JP | 2003-249297 | 9/2003 |
| JP | 2004-193079 | 7/2004 |
| JP | 2005-005135 | 1/2005 |
| JP | 2005-050685 | 2/2005 |
| JP | 2006-196427 | 7/2006 |

* cited by examiner

*Primary Examiner* — T C Patel
*Assistant Examiner* — Travis Chambers
(74) *Attorney, Agent, or Firm* — Harrington & Smith

(57) ABSTRACT

An electrical connector assembly for an airbag ignitor including a) a socket member having a mating aperture, an internal side wall portion having a locking slot, and a bottom wall portion having at least one pin contact extending therefrom; and b) a plug member adapted for mating with the socket member by insertion in the mating aperture and including a plug body and a plug nose, the plug nose including (i) at least one socket contact aperture for receiving a socket contact corresponding to a respective pin contact, and (ii) a resilient locking device adapted for engaging in the locking slot and locking the plug member in the socket member, wherein the plug member includes an annular gasket seal around the plug nose and under the plug body to seal the aperture between the socket member and the plug member when they mate.

9 Claims, 5 Drawing Sheets

ELECTRICAL CONNECTOR ASSEMBLY FOR AN AIRBAG IGNITOR

FIELD OF THE INVENTION

The present invention relates to electrical connectors for use with vehicle inflatable restraint systems, generally known as airbag systems. More particularly, the present invention relates to an electrical connector assembly for an airbag ignitor, the connector assembly comprising a socket member having a mating aperture, the mating aperture having a mating axis, a top wall portion, an internal side wall portion and a bottom wall portion, the side wall portion having a locking slot, the bottom wall portion having at least one pin contact, each pin contact extending from the bottom wall portion substantially parallel to the mating axis; and a plug member adapted for mating with the socket member by insertion in the mating aperture along the mating axis, the plug member comprising a plug body and a plug nose, this plug nose including a bottom surface having at least one socket contact aperture having a socket contact therein, said socket contact corresponding to a respective pin contact extending from the bottom wall portion of the mating aperture, and a resilient locking device adapted for engaging in the locking slot of the side wall portion of the socket member, the resilient locking device including at least two resilient arms spreading apart from said plug nose towards said plug body, said arms, upon application of a force to separate the plug member from the socket member, locking the plug member in the socket member and preventing separation of the plug member from the socket member.

BACKGROUND OF THE INVENTION

A connector system of this type is disclosed, for example, in U.S. Pat. No. 5,876,231. Such a system is known as a non-serviceable connector as the plug member and the socket member cannot be separated when the locking device is engaged in the locking slot.

Up to now, airbags have been mainly used to protect the driver and the passengers during an accident. Therefore, the airbags and their connectors are installed inside the passenger compartment.

Now, it appears a need to install an airbag under the hood of a car to protect a pedestrian bumped by the car and projected on the hood. With the current cars, this pedestrian crashes onto the motor, which generates serious injuries. The goal of the airbag is therefore to provide a smooth area to protect the pedestrian from a collision with the motor. However, the environment under the hood is more difficult than the environment of the passenger compartment in terms of moisture, temperature, dust . . . .

Therefore, there is a need for a rugged connector equipment adapted to such environment with a high level of reliability.

SUMMARY OF THE INVENTION

It is accordingly an object of the invention to provide an electrical connector assembly for an airbag ignitor as defined above, wherein the plug member further includes an annular gasket seal around the plug nose and under the plug body, said seal being adapted to seal the gap between the socket member and the plug member when the plug member is inserted into the socket member aperture.

Such an electrical connector assembly is particularly adapted to a harsh environment and more particularly protects the electrical connections from moisture. Such a connector assembly is particularly adapted to pass the tests used by the automotive industry to qualify the equipments installed in the motor compartment.

BRIEF DESCRIPTION OF THE DRAWINGS

The present invention is illustrated by way of example and not limitatively in the accompanying figures in which like reference numerals indicate similar elements and in which.

DESCRIPTION OF THE PREFERRED EMBODIMENTS

Figure 1:
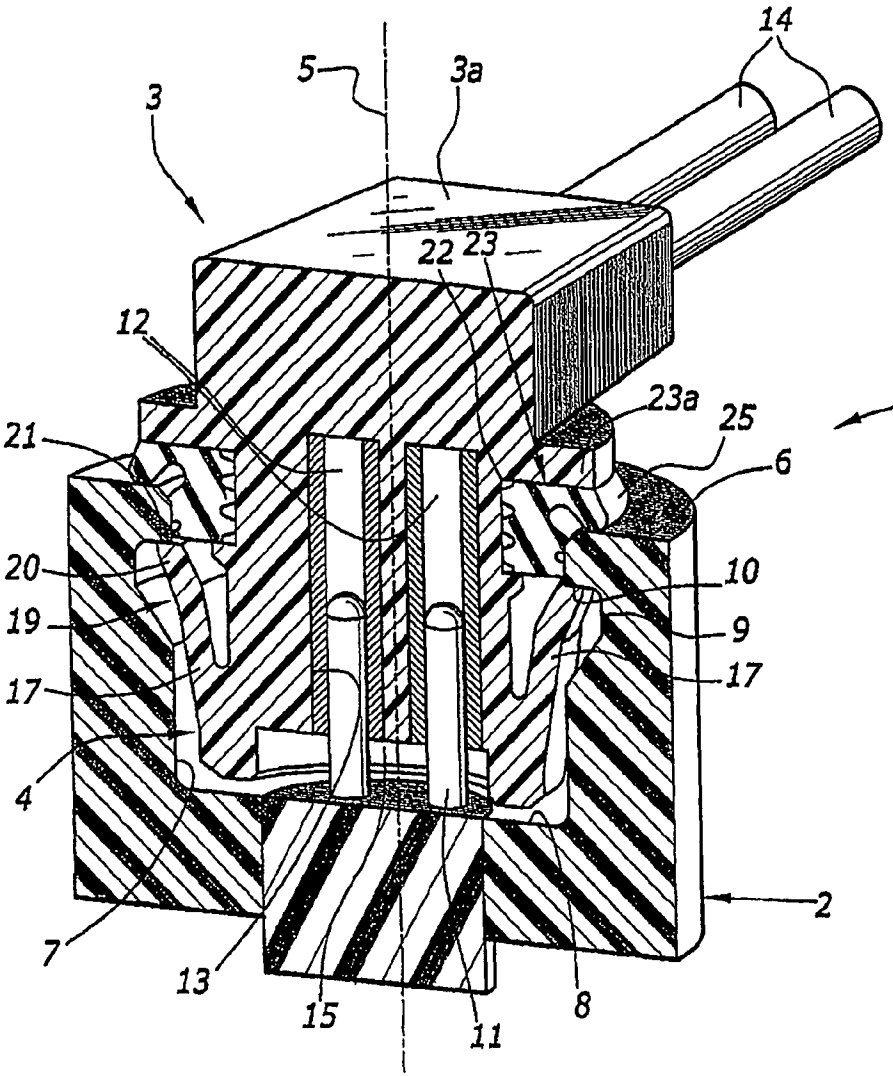
FIG. 1 is a perspective and cross-sectional view of the connector assembly according to the present invention, the socket member and the plug member being mated.

FIG. 1 shows a perspective and cross-sectional view of an electrical connector assembly 1. The connector assembly 1 comprises a socket member 2 and a plug member 3. The socket member 2 and the plug member 3 are adapted to mate together as shown in FIG. 1.

Figure 2:
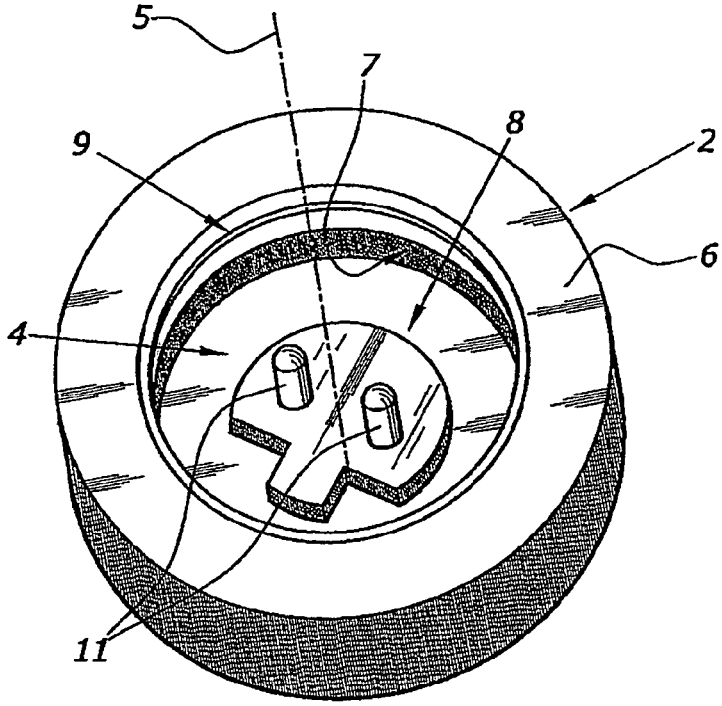
FIG. 2 is a perspective view of the socket member of the connector assembly of FIG. 1.

The socket member 2, FIG. 2, has a mating aperture 4. The mating aperture 4 has roughly a cylindrical form with a mating axis 5, a top flat wall portion 6, an internal side wall portion 7 and a bottom wall portion 8.

The side wall portion 7 has an annular locking slot 9. The locking slot 9 includes a top shoulder wall 10 that extends substantially perpendicular to the mating axis 5.

The bottom wall portion 8 has at least one pin contact 11. Each pin contact 11 extends from the bottom wall portion 8 substantially parallel to the mating axis 5.

Figure 3:
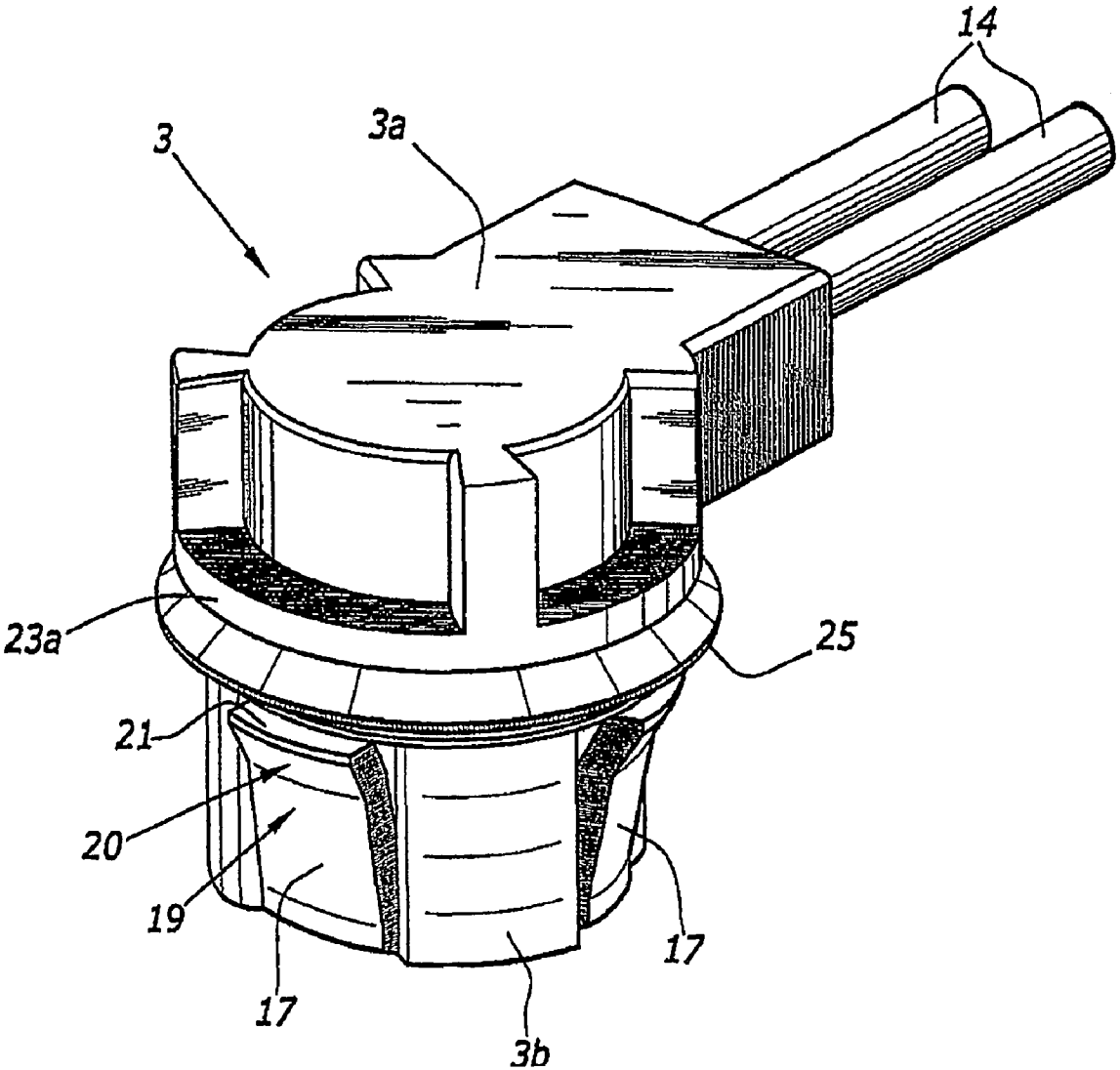
FIG. 3 is a perspective view of the top of the plug member of the connector assembly of FIG. 1.
Figure 4:
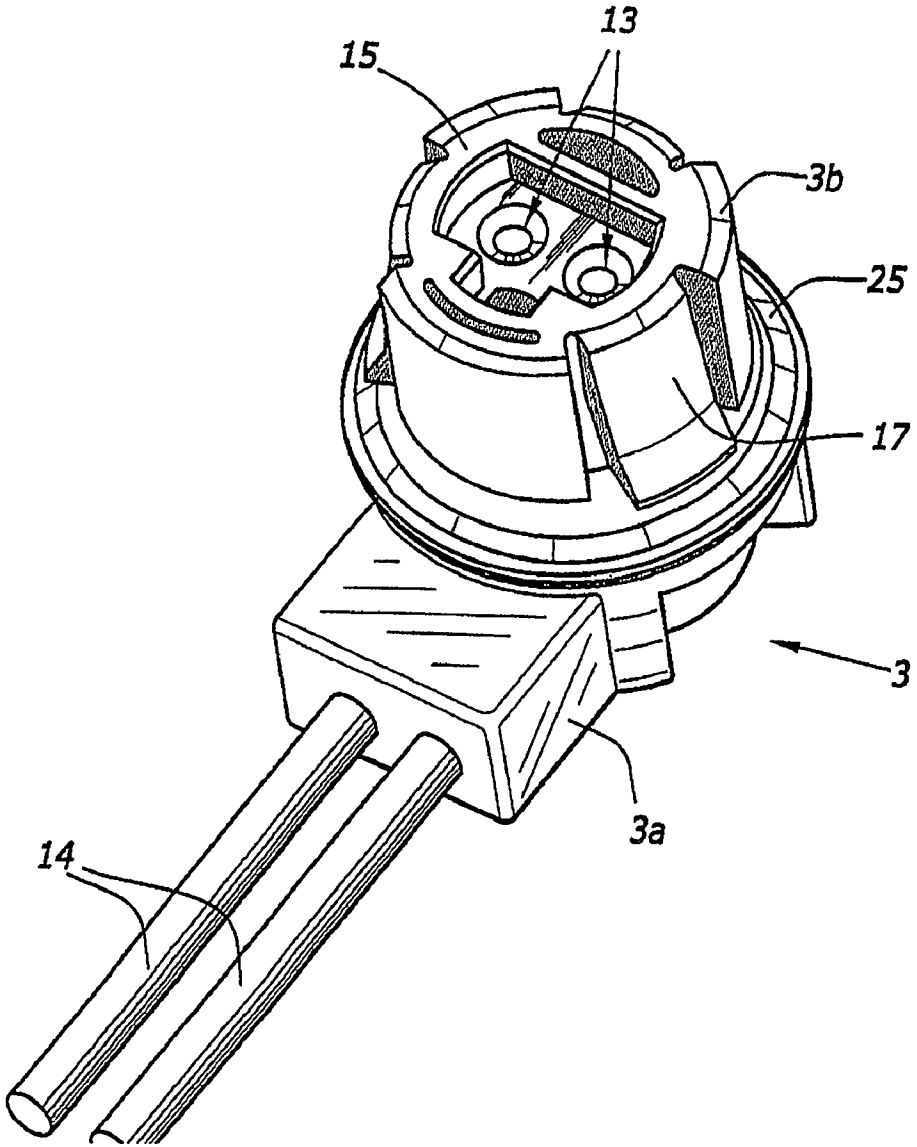
FIG. 4 is a perspective view of the bottom of the plug member of FIG. 3.

The plug member 3, FIGS. 1, 3 and 4, has a plug body 3*a* and a plug nose 3*b*.

The plug nose 3*b* includes socket contacts 12 disposed in socket contact apertures 13. The socket contacts 12 are electrically connected to conductors of wiring 14. Each socket contact 12 has a first end to receive a corresponding pin contact 11 and a second end for receiving a conductor of wiring 14. The apertures 13 open onto a bottom surface 15 of the plug nose 3*b*.

The plug nose 3*b* also includes a resilient locking device having three resilient arms 17. Each arm 17 obliquely extends upwardly from a region adjacent the bottom surface 15 of the plug nose 3*b* and is adapted for engaging the locking slot 9 of the side wall portion 7 of the mating aperture 4. Each arm 17 includes an upper detent portion 19 that has a divergent portion 20 and an abutment portion 21.

When the plug nose is inserted into the aperture 4, the arms 17 are flexed towards axis 5, then resiliently spread apart in the slot 9.

Abutment portion 21 extends substantially perpendicular to the mating axis 5 and abuts shoulder portion 10 of locking slot 9, preventing separation of plug member 3 from socket member 2 when a force is applied for separating member 3 from member 2.

Figure 5:
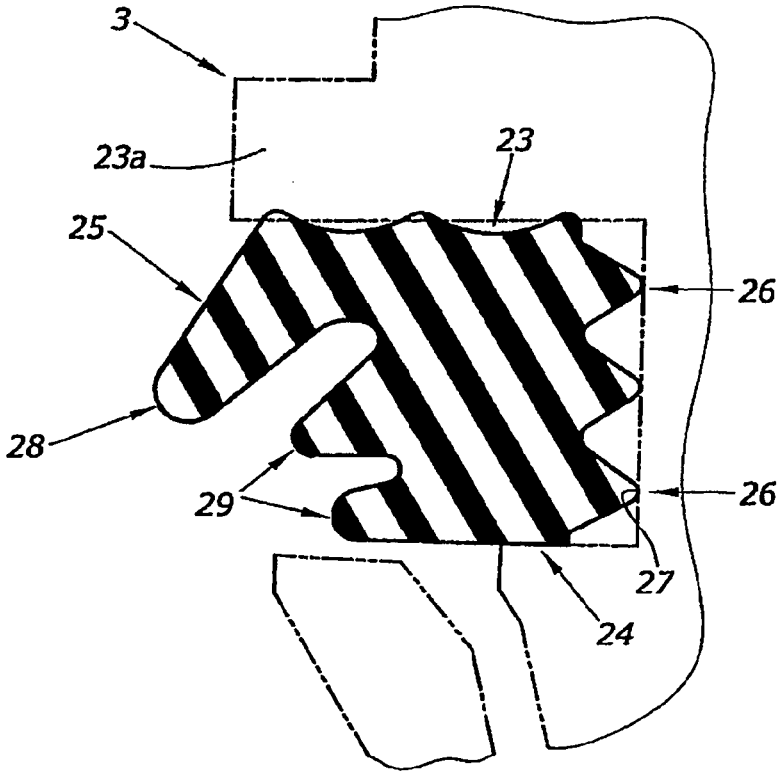
FIG. 5 is an axial sectional view of a detail of the gasket seal of the connector assembly according to the present invention.

The plug member 3 further includes an annular slot 22, FIGS. 1 and 5, in the top portion of the plug nose 3*b*. The slot 22 extends between two shoulder portions 23, 24 that extend substantially perpendicular to the mating axis 5.

The top shoulder portion 23 is preferably formed by an annular bottom wall surface of an annular flange 23*a* of the plug body 3*a*, said bottom wall surface having an outer diameter substantially greater than the diameter of the mating aperture 4.

The slot 22, the bottom of which is substantially parallel to the mating axis 4, maintains an annular gasket seal 25 in position.

Figure 6:
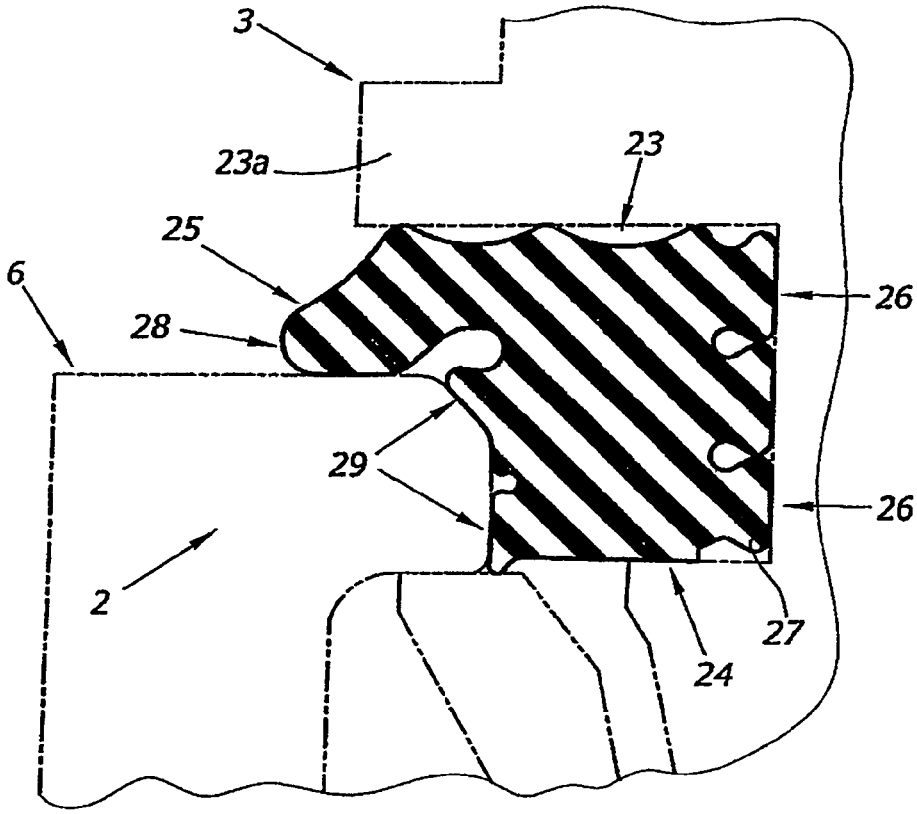
FIG. 6 is an axial sectional view of a detail of the gasket seal of FIG. 5, the socket member and the plug member being mated.

The annular gasket seal 25, FIGS. 5 and 6, has on its internal surface annular ridges 26, which are pressed against the bottom of slot 22, providing an effective seal.

The external surface of the gasket seal 25 has one or more lips 28, 29.

In the illustrated preferred embodiment, the gasket seal 25 has a top lip 28 and two lower lips 29.

The top lip 28 is obliquely directed towards the top wall portion 6 of the socket member 2, and the lower lips 29 extend radially towards the internal side wall portion 7, so that, when the plug member 3 mates with the socket member 2 and is locked in position by the arms 17, the first lip 28 is pressed between the top wall portion 6 of the socket member 2 and the bottom wall surface 23 of the plug member 3 and spreads apart, providing an effective seal.

The lower lips 29 pressing against the side wall portion 7 provide an additional sealing effect, the seal 25 being pressed in the annular gap between the plug nose 3*b* and the side wall portion 7 of the socket member 2.

The invention claimed is:

1. An electrical connector assembly for an airbag ignitor, the connector assembly comprising:

a) a socket member having a mating aperture, the mating aperture having a mating axis, a top wall portion, an internal side wall portion and a bottom wall portion, the side wall portion having a locking slot, the bottom wall portion having at least one pin contact, each pin contact extending from the bottom wall portion substantially parallel to the mating axis; and b) a plug member adapted for mating with the socket member by insertion in the mating aperture along the mating axis, the plug member comprising a plug body and a plug nose, said plug nose including:

(i) a bottom surface having at least one socket contact aperture having a socket contact therein, said socket contact corresponding to a respective pin contact extending from the bottom wall portion of the mating aperture, and (ii) a resilient locking device adapted for engaging in the locking slot of the side wall portion of the socket member, locking the plug member in the socket member and preventing separation of the plug member from the socket member, wherein the plug member further includes an annular gasket seal around the plug nose and under the plug body, said gasket seal being adapted to seal the gap between the socket member and the plug member when the plug member is inserted into the socket member aperture, wherein the gasket seal comprises a top lip obliquely angled towards the top wall of the socket member such that said top lip deflects outward when the plug member is inserted into the socket member, and at least one radially extending lip sealing the gap between the plug nose and the internal side wall portion of the aperture of the socket member.

2. The electrical connector assembly according to claim 1, wherein the gasket seal comprises at least two radially extending lips adapted to engage the side wall portion of the aperture of the socket member.

3. The electrical connector assembly according to claim 1, wherein the plug nose has an annular slot under the plug body adapted to keep the gasket seal in position when the plug member is not inserted into the socket member aperture.

4. The electrical connector assembly according to claim 1, wherein the radially internal surface of the gasket seal have annular ridges, which are pressed against the plug member.

5. The electrical connector assembly according to claim 1, wherein the resilient locking device includes at least two resilient arms spreading apart from said plug nose towards said plug body, said arms locking the plug member in the socket member preventing separation of the plug member from the socket member upon application of a force to separate the plug member from the socket member.

6. The electrical connector assembly according to claim 1, wherein the plug body comprises an annular bottom wall surface around the plug nose, said bottom wall surface being adapted to press the gasket seal against the socket member when the plug member is inserted into the socket member aperture.

7. The electrical connector assembly according to claim 6, wherein said bottom wall surface is adapted to press a top portion of the gasket seal against the top wall portion of the socket member.

8. An electrical connector plug which is sized and shaped for mating with an electrical connector socket by insertion into a mating aperture of the socket along a mating axis, the plug including a plug nose, the plug nose comprising:

a bottom surface having at least one socket contact aperture, a resilient locking device adapted to engage a locking slot in a side wall of the socket to lock the plug in the socket and prevent separation of the plug from the socket, and an annular gasket seal around the plug nose and under a portion of a plug body of the plug, the gasket seal being adapted to seal a gap between the socket and the plug when the plug is inserted into the mating aperture, wherein the gasket seal comprises a first lip extending radially outward in a first direction and adapted to seal the gap between the plug nose and the side wall of the socket in the mating aperture, and a second lip extending outward in a second different direction, obliquely angled relative to the first direction, such that the second lip deflects outward when the plug is connected to the socket.

9. An electrical connector plug which is sized and shaped for mating with an electrical connector socket by insertion into a mating aperture of the socket along a mating axis, the plug including a plug nose, the plug nose comprising:

a bottom surface having at least one socket contact aperture, a resilient locking device adapted for engaging a locking slot of a side wall of the socket to lock the plug in the socket and prevent separation of the plug from the socket, and an annular gasket seal around the plug nose and under a portion of a plug body of the plug, the gasket seal being adapted to seal a gap between the socket and the plug when the plug is inserted into the mating aperture, wherein the gasket seal comprises a first lip extending radially outward in a first direction and adapted to seal a portion of the gap between the plug nose and the side wall of the socket in the mating aperture, and a second lip extending outward in a second direction, obliquely angled relative to the first direction, such that the second lip at least partially rotates outward when the plug is connected to the socket.

* * * * *